United States Patent [19]

Pierce, Jr.

[11] Patent Number: 4,813,554

[45] Date of Patent: Mar. 21, 1989

[54] REVERSIBLE, ADJUSTABLE, STACKABLE LOADING GRID ASSEMBLY

[75] Inventor: Clifford R. Pierce, Jr., Perkasie, Pa.

[73] Assignee: Vacuum Furnace Systems Corporation, Souderton, Pa.

[21] Appl. No.: 60,775

[22] Filed: Jun. 12, 1987

[51] Int. Cl.[4] ..... A47B 47/00

[52] U.S. Cl. ..... 211/188; 211/189; 108/111

[58] Field of Search ..... 211/188, 194, 113, 153, 211/191, 175, 189, 200, 195; 108/111; 34/240

[56] References Cited

U.S. PATENT DOCUMENTS

| | | | |
|---|---|---|---|
| 2,919,817 | 1/1960 | Maslow | 108/111 |
| 3,948,581 | 4/1976 | Helman et al. | 108/111 X |
| 4,167,908 | 9/1979 | Jones et al. | 108/111 |
| 4,257,333 | 3/1981 | Pollack | 108/111 X |
| 4,261,470 | 4/1981 | Dolan | 211/191 |
| 4,325,486 | 4/1982 | Neal | 211/113 X |

*Primary Examiner*—Reinaldo P. Machado

*Assistant Examiner*—Sarah A. Lechok Eley

*Attorney, Agent, or Firm*—William E. Cleaver

[57] ABSTRACT

The present loading grid assembly includes a plurality of support bars which are held together by assembly support rods which lie orthogonal thereto. The assembly support rods are terminated in end blocks which have grooves formed therein and which are formed to be substantially symmetrical about the assemby support rods. Accordingly, the assembly can be turned over so that any sag which results from a load is reversed thereby providing wear on the upper and lower sides of the assembly. In addition, the present device includes post guides, spacer blocks, stacking posts and interlocking members. The post guides fit into the grooves of the end blocks and into grooves of the stacking posts to provide a support means for a second tier of support bars. The spacer blocks fit over the assembly support rods to define a changeable separation between adjacent support bars while the interlocking members securely separate adjacent bars and provide further vertical support to an assembly.

8 Claims, 3 Drawing Sheets

REVERSIBLE, ADJUSTABLE, STACKABLE LOADING GRID ASSEMBLY

BACKGROUND OF THE DISCLOSURE

As is well understood in the vacuum furnace art, work pieces (e.g., tools which are being hardened and the like) are held by loadable devices such as racks or hearths. The loadable devices are designed to permit exposure of the work pieces for both heating and quenching. A major problem that occurs is that the loadable devices are subjected to great heat and since the loadable device is very often supporting a great deal of weight, the frame of a device sags and/or is in some way distorted. As a result of such distortion, when next the loadable device is used the work pieces do not lie evenly and this results in uneven distribution of applied heat and an uneven exposure to quenching gas (i.e. uneven hardening). In addition in the prior art, the loadable devices have not been flexible by way of accommodating different widths or lengths of work pieces nor have prior art loadable devices been designed to accommodate different heights of work pieces.

The present device is reversible to insure that the sag wear and distortion can be shared on both sides of an assembly. In addition, it provides for changing the separation between support bars to accommodate different sizes of work pieces and, in addition, by design, permits an assembly to be stacked with other like assemblies to effect different heights therebetween.

SUMMARY OF THE DISCLOSURE

The present loading grid device is reversible, adjustable, and stackable. The grid is composed of a plurality of support bars made, in the preferred embodiment, of molybdenum. The support bars have holes in at least each end and passing through those holes are at least two support assembly rods with one rod on each end. The support assembly rods are held at each end thereof by an end block. Hence, a rectangular grid (as viewed from the top) is made up of support bars which run horizontally, at least two support assembly rods which run vertically and four end blocks, one end block each being located at the corners of the grid. The end blocks extend symmetrically above and below the assembly support rods so that the end blocks hold and support the support bars in the same fashion as legs of a table support the table top. Of course, if the grid assembly is flipped over, the upper surface of the end block becomes the resting surface and the underside of the support bar become the upper side of the assembly which now defines the "surface plane" upon which the work pieces are located. Once such a loadable assembly is in the furnace and is supporting a heavy load and is subjected to high temperatures, the rods and support bars very often sag and the assembly becomes distorted. By being able to reverse the assembly, the former lower side, which would be bulging toward the work pieces, when reversed, is caused to start a reverse sag. Accordingly, the assembly is able to endure for a longer life than in the prior art with respect to the wear factor created by the above described distortion.

In addition, the assembly provides spacers which fit onto the assembly support rods and which interlock to adjacent support bars. The spacers can be of varying widths so that the space between the support bars can be varied. Accordingly, if the vacuum furnace were heat treating a 6" tool on one occasion and a 2" engine part on another occasion, the spacers between the support bars could be changed from, for instance, a 4 inch space to accommodate the 6" tool to a 1" space to accommodate a 2" engine part if it were deemed advantageous to do so.

Along the support assembly rods there can be located interlocking members which analogously act as more legs to support the table. Further, in addition, the end blocks are formed with grooves to fit (by groove and tongue) with stacking pieces. Each stacking piece locks into an end block at one end of the stacking piece and each is formed to be locked into an end block of a second grid assembly at the other end of the stacking piece. Hence, a second grid assembly can be stacked above a first grid assembly for the purpose of holding a second group of work pieces.

The objects and features of the present invention will be better understood when considered in view of the following description. Taken in conjunction with the drawings wherein.

Figure 1:
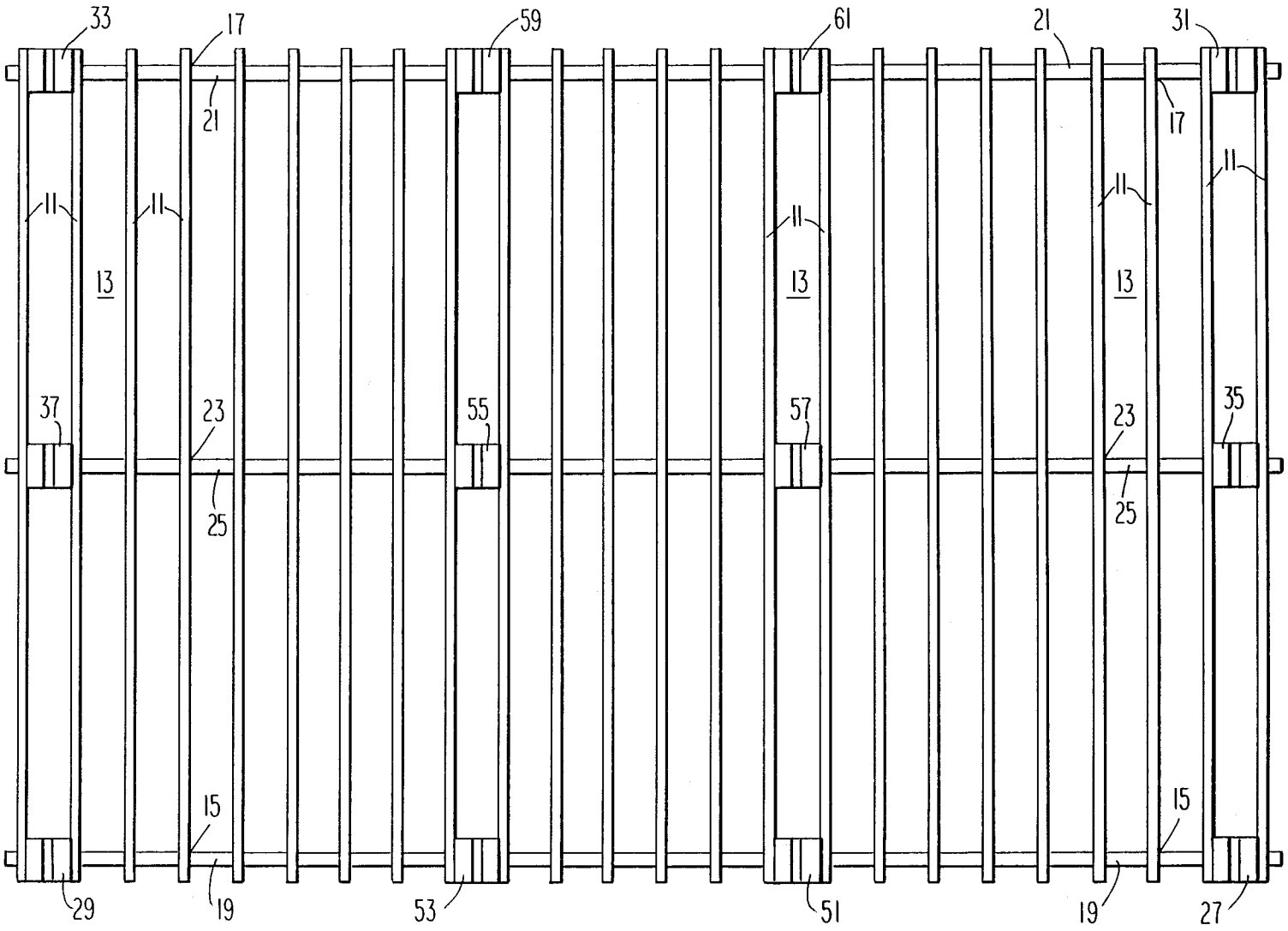
FIG. 1 is a top view of the loadable grid assembly.

Consider FIG. 1 which depicts a top view of a loadable grid assembly. It should be understood that FIG. 1 represents a top view of just one assembly plane upon which work pieces can be loaded. That is to say, there can be, and in all probability will be, a number of plane devices, or grid assemblies, stacked on top of one another, with each of said building grid assemblies holding a plurality of work pieces. As can be seen in FIG. 1 there is a plurality of support bars 11. Each of the support bars is not numerically identified but it should be understood that all of the bars (which run vertically as viewed in FIG. 1) are support bars 11. It should also be understood that the support bars are actually substantially horizontal in the furnace or substantially parallel to the furnace floor. The support bars act to either hold devices such as baskets, or hold the work pieces themselves. If work pieces, per se, are held they are located to bridge the spaces, such as the spaces 13, between the support bars 11. The work pieces are loaded so that they are subject to the heat of the vacuum furnace and so that they are subject to quenching gas which cools such work pieces after they have been properly heat treated. It should be understood that each of the support bars 11 has a hole formed in each end, such as the holes 15 and 17, which are identified by their location in FIG. 1 rather than by their actual visibility. Passing through each of the holes 15 is a support assembly rod 19 and passing through each of the holes 17 is a support assembly rod 21. In the embodiment shown in FIG. 1 each of the support bars 11 has a third hole therein 23 and passing through each of the holes 23 is a rod 25. As can be further gleaned from FIG. 1 at each end of the assembly support rod there is located at least two end blocks. For instance, at the first end of assembly support rod 19, there is located an end block device 27 and at its second end there is an end block member 29. In like fashion with respect to the rod 21 at a first end there is an end block member 31 while at the second end there is a and block member 33. In a similar fashion at a first end of the assembly support rod 25 there is an end block member 35 and at the other end there is an end block member 37.

Figure 2:
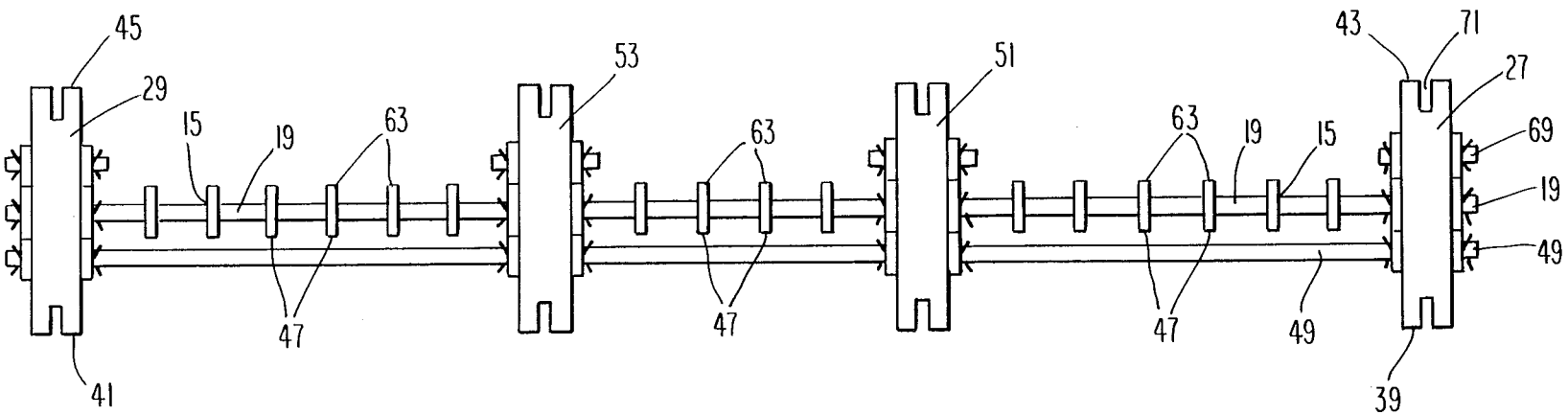
FIG. 2 is a side view of FIG. 1.

It should be apparent from FIG. 2 that an end block, such as end blocks 27 and 29, extend above and below the support rod 19. When the loading grid assembly is in the position shown in FIG. 2 then the surface 39 and the surface 41 become the resting surfaces, that is, the bottom of the "table legs." When the loading grid assembly shown in FIG. 2 is flipped over, then the surfaces 43 and 45 become the resting surfaces and the surfaces 47 become the upper surfaces of the support bars. In the flipped over position, the work pieces are loaded on the surfaces 47. As is readily apparent in FIG. 2 there is a second support rod 49 running through the end blocks 27 and 29. The second support rod 49 is present to keep the end blocks from rotating around the support rods such as support rod 19. Also as can be gleaned from FIG. 2 there are two additional blocks 51 and 53 which are similar to the end blocks 27 and 29 but which are located towards the center of the assembly. The additional blocks 51 and 53 also extend above and below the rod 19 and function in a "table leg" mode and simply add more support to the whole assembly.

Examining FIG. 1 once again we find that there are the additional blocks 55 and 57 which are mounted on the rod 25 and the additional blocks 59 and 61 which are mounted on the rod 21. The role of those additional blocks 55, 57, 59 and 61 are the same as the blocks 51 and 53 previously described.

Again if we examine FIG. 2, it should be understood that when the work pieces are loaded on the grid assembly, as depicted in FIG. 2, then the work pieces will be loaded on the surfaces 63.

Figure 3:
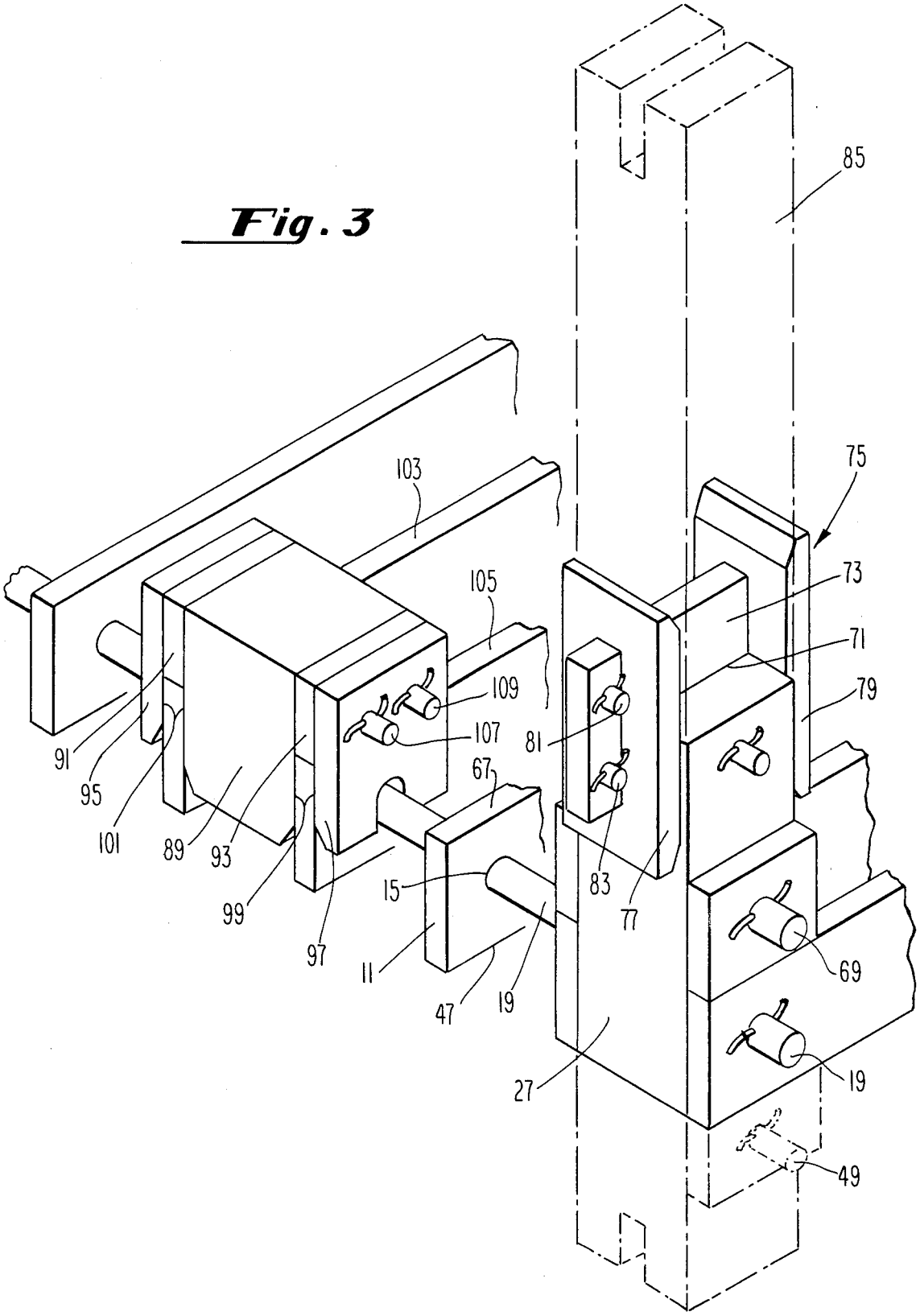
FIG. 3 is an enlarged pictorial view of the assembly at the end block.

Examine FIG. 3. FIG. 3 depicts some of the assembly possibilities of the present device. In FIG. 3 there is shown the southeast corner of FIG. 1 with the end block 27, a portion of the support rod 19, a portion of one of the support bars 11, with an aperture 15 therethrough, as well as a lower surface 47 and an upper surface 67. FIG. 3 depicts a number of the features found in FIG. 2. For instance, the locking pin 69 which is shown in FIG. 2 is present; the end of rod 19 which is shown in FIG. 2 is present; and the end of rod 49 (which is shown in phantom) is depicted as it is shown in FIG. 2. Although the rod 49 is shown in phantom is FIG. 3, it is not shown passing through the block and continuing down the pictorial shown in FIG. 3. The groove 71 shown in FIG. 2 is also shown in FIG. 3 but inserted into that groove 71 in FIG. 3 is the extension of the block 73. In other words the lower half of the block 73 acts as a "tongue" which is inserted into the groove 71. The block 73 is the middle piece of a stacking member 75. The stacking member 75 is made up on two end pieces, respectively 77 and 79 which are held secure by four locking pins, two of which (81 and 83) are shown. The stacking member 75 is fitted into the upper end of the end block 27 in particular into the groove 71 and provides a protrusion or a tongue which is capable of having a second stacking member loaded thereon or is capable of having an end block loaded thereon. In FIG. 3 there is shown in phantom an end block 85 which is fitted onto the stacking member 75. It should be readily understood that the end block 85 is analogous to the end block 27 and would be the basis of carrying a second loading grid assembly on top of a first loading grid assembly.

Further in FIG. 3 it can be readily seen that there is a spacer assembly 87 which in particular is identified by the cross-sectional marking. The spacer assembly is made up of a middle piece 89 and on the ends thereof there are located two intermediate blocks 91 and 93. On the ends of intermediate blocks 91 and 93 are located two end blocks 95 and 97. As can be understood by examination of FIG. 3 the length of the end block 97 and the length of the middle piece 89 create a groove 99 therebetween, just as the length of the end block 95 and the length of the middle piece 89 form a groove 101 therebetween. The grooves 99 and 101 enable the spacer device to be fitted onto the support bars 103 and 105 so as to separate the support bars 103 and 105 a particular distance apart. It should be understood that the middle piece 89 can be different widths to separate the support bars 103 and 105 different distances apart. It can be readily understood that the spacer assembly is secured together by the two connecting pins 107 and 109.

The loading grid assembly just described is reversible. If we examine FIG. 2, it should be recognized that the assembly can be flipped over so that the surfaces 43 and 45 become the "bottom" or the resting surfaces and the support for surfaces upon which the work pieces are loaded would be surfaces 47. This arrangement provides that if the support bars sag (as in fact support bars do), then the assembly can be reversed or flipped over and the support bars when they do sag will sag in the opposite direction. The present assembly is adjustable because as described above, the spacer assemblies such as 87 can be located readily along the support rods separating the support bars into different spaces. Further, the present assembly is stackable because the end blocks provide grooves into which stacking pieces, such as stacking piece 75, can be located and end blocks of other assemblies can be loaded on top thereof.

I claim:

1. A reversible and adjustable loading grid assembly for use in supporting work pieces in a vacuum furnace, comprising in combination: a plurality of support bars each having at least a first end with a first aperture formed therein and a second end with a second aperture formed therein, said support bars disposed to be substantially horizontal in order to hold work pieces to be treated in said vacuum furnace; first assembly support means having first and second ends, said first assembly support means disposed to lie in substantially the same horizontal plane of an substantially orthogonal to said support bars and disposed to pass through said first apertures of said support bars to hold said support bars with spaces therebetween and formed to permit said support bars to be movable over said first assembly support means; second assembly support means having first and second ends, said second assembly support means disposed to lie in substantially the same horizontal plane of and substantially orthogonal to said support bars and disposed to pass through said second apertures of said support bars and formed to permit said support bars to be movable over said second assembly support means; first and second end support means each having first and second contact ends and each having apertures therein formed to respectively receive and hold said first and second ends of said first assembly support means; third and fourth end support means each having first and second contact ends and each having apertures therein formed to respectively receive said first and second ends of said second assembly support means whereby said support bars can be moved along said first and second assembly support means to vary said spaces between said support bars to support different size work pieces and whereby said loading grid assembly is in one position when said first contact ends face the bottom of the vacuum furnace with which the assembly is being used and is in a reversed second position when said second contact ends face the bottom of the vacuum furnace with which it is being used.

2. A reversible and adjustable loading grid assembly according to claim 1 and wherein there is further included a plurality of stacking pieces each formed to fit with a different associated one of said first, second, third and fourth end support means to provide a means to support a second grid assembly located upward in said vacuum furnace from said first mentioned loading assembly.

3. A reversible and adjustable loading grid assembly according to claim 1 and wherein there is further included at least first and second interlocking members; said first interlocking member having at least one aperture therethrough, said last mentioned aperture formed to have said first interlocking member fitting over said first assembly support means and between the first ends of two adjacent support bars, said two adjacent support bars secured in abutment with said first interlocking means; said second interlocking means having at least one aperture therethrough, said last mentioned aperture formed to have said second interlocking means fitting over said second assembly support means and between the second ends of said two adjacent support bars, said two adjacent support bars secured in abutment with said second interlocking means, whereby additional support is provided to said loading grid assembly to hold the work pieces loaded thereon.

4. A reversible and adjustable loading grid assembly according to claim 2 and wherein there is included a plurality of stacking piece guides each of which is formed to fit with a different one of said end support means and a different one of said stacking pieces and each of said stacking piece guides is disposed between an associated one of said end support means and its associated stacking piece.

5. A reversible and adjustable loading grid assembly according to claim 1 and wherein there is further included at least first and second spacer blocks, said first spacer blocks formed and disposed to fit in a removable and locking position between the first ends of two adjacent support bars, said second spacer blocks formed and disposed to fit in a removable locking position between said second ends of said two adjacent support bars whereby the distance between said two adjacent support bars can be determined by the width of said first and second spacer blocks.

6. A reversible and adjustable loading grid assembly according to claim 5 and wherein said first and second spacer blocks are formed to respectively fit over said first and second assembly support means.

7. A reversible and adjustable loading grid assembly according to claim 1 wherein said support bar each has a third aperture formed in its first end and a fourth aperture formed in its second end and wherein there are further included third and fourth assembly support means with said third assembly support means passing through said third apertures in said support bars so that said third assembly support means lies substantially parallel to said first assembly support means and with said four assembly support means passing through said fourth apertures in said support bars so that said fourth assembly support means lies substantially parallel to said second assembly support means.

8. A reversible, adjustable, stackable load grid assembly for use to support work pieces in a vacuum furnace comprising in combination: a plurality of support bars each having at least a first end with a first aperture formed therein and a second end with a second aperture formed therein, said support bars disposed to be substantially horizontal in order to hold work pieces to be treated in said vacuum furnace; first assembly support means having first and second ends, said first assembly support means disposed to lie in substantially the same horizontal plane of and substantially orthogonal to said support bars and disposed to pass through said first apertures of said support bars to hold said support bars with spaces therebetween and formed to permit said support bars to be movable over said first assembly support means; second assembly support means having first and second ends, said second assembly support means disposed to lie in substantially the same horizontal plane of and substantially orthogonal to said support bars and disposed to pass through said second apertures of said support bars and formed to permit said support bars to be movable over said second assembly support means; first and second end support means each having first and second contact ends and each having apertures therein formed to respectively receive and hold said first and second ends of said first assembly support means; third and fourth end support means each having first and second contact ends and each having an aperture therein formed to respectively receive and hold said first and second ends of said second assembly support means whereby said support bars can be moved along said first and second assembly support means by way of adjustment to vary said spaces therebetween to accommodate different size work pieces and whereby said loading grid assembly is in one position when said first contact ends face the bottom of the vacuum furnace with which the assembly is being used and is in the reversed second position when said second contact ends face the bottom of the vacuum furnace with which it is being used; a plurality of stacking pieces; a plurality of stacking piece guides each of which is formed to interlockingly fit and disposed to fit with different ones of said end support means and a different one of said stacking pieces whereby a second grid assembly can be held on top of a first grid assembly.

* * * * *